US009611593B2

(12) United States Patent
Schenk

(10) Patent No.: US 9,611,593 B2
(45) Date of Patent: Apr. 4, 2017

(54) DOWELS FOR JOINTED CONCRETE AND METHODS OF FORMING AND USING THE SAME

(71) Applicant: Christopher P. Schenk, Chicago, IL (US)

(72) Inventor: Christopher P. Schenk, Chicago, IL (US)

( * ) Notice: Subject to any disclaimer, the term of this patent is extended or adjusted under 35 U.S.C. 154(b) by 0 days.

(21) Appl. No.: 15/332,637

(22) Filed: Oct. 24, 2016

(65) Prior Publication Data

US 2017/0067212 A1 Mar. 9, 2017

Related U.S. Application Data

(63) Continuation of application No. 14/802,024, filed on Jul. 17, 2015, now Pat. No. 9,476,165, which is a continuation-in-part of application No. 14/336,310, filed on Jul. 21, 2014.

(60) Provisional application No. 62/132,786, filed on Mar. 13, 2015.

(51) Int. Cl.

| | |
|---|---|
| ***E01C 5/00*** | (2006.01) |
| ***E01C 11/14*** | (2006.01) |
| ***E01C 11/20*** | (2006.01) |
| ***E01C 11/06*** | (2006.01) |

(52) U.S. Cl.

CPC ..... *E01C 11/14* (2013.01); *E01C 5/003* (2013.01); *E01C 11/06* (2013.01); *E01C 11/20* (2013.01)

(58) Field of Classification Search

CPC ..... E01C 11/14; E01C 11/20; E01C 11/06; E01C 5/003

USPC ..... 404/56–67

See application file for complete search history.

(56) References Cited

U.S. PATENT DOCUMENTS

| | | | | |
|---|---|---|---|---|
| 3,927,816 | A | 12/1975 | Nakamura | |
| 4,120,128 | A | 10/1978 | Pauls | |
| 4,589,499 | A | 5/1986 | Behrens | |
| 5,040,350 | A | 8/1991 | Panther | |
| 5,492,431 | A | 2/1996 | Rasmussen et al. | |
| 5,540,292 | A | 7/1996 | Behrens | |
| 6,082,469 | A | 7/2000 | Kromray, Jr. | |
| 6,481,507 | B1 | 11/2002 | Kromray, Jr. | |
| 6,517,277 | B2 | 2/2003 | Hu et al. | |
| 7,553,554 | B2 * | 6/2009 | Miller | E01C 11/14 411/902 |
| 8,591,139 | B2 * | 11/2013 | Gibson | E01C 11/14 404/51 |
| 8,911,173 | B2 | 12/2014 | Ulislam | |
| 2005/0265802 | A1 | 12/2005 | Miller et al. | |
| 2006/0127179 | A1 | 6/2006 | Nadler | |
| 2006/0177268 | A1 | 8/2006 | Kramer | |
| 2013/0115000 | A1 | 5/2013 | Smith | |

FOREIGN PATENT DOCUMENTS

JP 2003-326312 A 11/2003

* cited by examiner

*Primary Examiner* — Raymond W Addie

(74) *Attorney, Agent, or Firm* — Thompson Coburn, LLP; Clyde Smith

(57) ABSTRACT

A concrete dowel tube made of carbon steel comprises a welded longitudinal seam.

2 Claims, 8 Drawing Sheets

DOWELS FOR JOINTED CONCRETE AND METHODS OF FORMING AND USING THE SAME

CROSS-REFERENCE TO RELATED APPLICATIONS

This application is a continuation of currently pending U.S. patent application Ser. No. 14/802,024, filed on Jul. 17, 2015, now U.S. Pat. No. 9,476,165 which is a continuation-in-part of U.S. patent application Ser. No. 14/336,310, filed on Jul. 21, 2014, and which claims priority to Provisional Patent Application Ser. No. 62/132,786, filed on Mar. 13, 2015.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

The present invention pertains to jointed concrete. More particularly, the present invention pertains to the use of hollow carbon steel dowels in jointed concrete pavement and methods of forming and using such dowels.

General Background

To prevent concrete pavement from cracking along random fracture lines, it is common to partially cut through new pavement to create intentional fracture lines. However, creating near planar fractures in pavement prevents the concrete from transferring any appreciable out-of-plane shear loads across such joints. Thus, to prevent adjacent sections of concrete from shifting out-of-plane relative to each other, metal dowels running parallel to the pavement are often positioned within the concrete across such joint lines before the concrete cures. Once the concrete fractures along the joint, the dowels transfer the shear loads between adjacent sections of concrete to thereby prevent relative transverse movement between such sections of concrete.

Most concrete pavement dowels are solid carbon steel cylindrical rods. Such dowels are fairly inexpensive and are cut from longer lengths of rod. Typically, long rods of carbon steel are shipped to a processing center or to a job site, where they are then batch cut to length for use as dowels. The batch cutting typically involves placing a plurality of rods (20 or more) in a basket or cradle style holder and thereafter cross-cutting the plurality of rods to length via a band saw. To reduce corrosion, carbon steel dowels may be galvanized, epoxy coated, or otherwise coated to reduce corrosion.

In rare situations requiring extremely long life pavement or involving pavement in abnormally corrosive environments, stainless steel dowels are used. In view of the relatively high cost of stainless steel compared to carbon steel, such stainless dowels are typically welded tube rather than solid rod. The added cost of forming the welded stainless tube is justified by the lower total material cost of the dowels. However, like the standard carbon steel rods, stainless steel tube dowels are typically batch cut from long cylindrical tubes of stainless steel that are shipped to a processing center or to a job site. In view of the inherent corrosion resistance of stainless steel, coating such stainless steel tube dowels with epoxy or otherwise coating such dowels is not necessary. It should be appreciated however that stainless steel tube dowels are significantly more expensive compared to carbon steel rod dowels.

Concrete pavement dowels can be placed in concrete in several ways. Prior to pouring the concrete, the dowels may be placed on baskets or cradles. The concrete can then be poured over the dowels, with the baskets or cradles holding the dowels near the center of the pavement thickness. Alternatively, it has been increasingly common to place the dowels into poured uncured concrete, thereby eliminating the need for baskets or cradles. The dowels can be placed in the uncured concrete by hand or in an automated manner via a concrete paving machine.

Concrete pavement dowels are also used to repair concrete pavement and to merge new concrete pavement to existing cured concrete pavement. In such situations, a vertical cut face of the cured concrete is either exposed or formed. Thereafter, a plurality of horizontal holes are drilled into the vertical face of the cured concrete and dowels are inserted into the holes. The dowels are longer than the depth of the holes and therefore protrude outward from the vertical face. New concrete is then poured over and around the exposed portions of the dowels in a manner forming a new section of concrete pavement. Once cured, the interface between the old and new concrete can be partially cut to form a fracture line. When fractured, the dowels will carry any shear loads between the old and new sections of concrete.

SUMMARY OF THE INVENTION

Although the use of carbon steel rod dowels is not seen as problematic, the inventor has conceived of using carbon steel tube dowels in lieu of solid rod dowels. Although others have assumed that the carbon steel tube dowels would be more costly than carbon steel rod dowels, the inventor has conceived of a manner of producing carbon steel tube dowels that renders such carbon steel tube dowels fifteen or more percent less expensive to produce as compared to current carbon steel rod dowels.

One aspect of the invention pertains to a method of forming jointed concrete dowels. The method comprises unspooling a coil of carbon steel strip and directing the uncoiled strip along a path. The uncoiled strip has opposite side edges that extend along the path. The method further comprises bending the strip into a hollow tube in a manner such that the side edges are adjacent to each other, and thereafter electric resistance welding the side edges of the strip to each other such that the hollow tube has a closed transverse cross-section. Still further, the method comprises transversely cutting the welded hollow tube into a plurality of jointed concrete dowels. The steps of unspooling the coil, bending the strip, and electric resistance welding the side edges of the strip occurs continuously as the strip is uncoiled and travels along the path, and the step of transversely cutting the hollow tube occurs as the hollow tube travels along the path.

Another aspect of the invention pertains to a method of forming jointed concrete pavement. The method comprises positioning a dowel in a location that will become pavement. The dowel comprises a carbon steel welded seam hollow tube and a pair of end caps. The caps are attached to opposite axial ends of the hollow tube. The method further comprises allowing concrete to cure around the dowel to thereby transform the concrete into pavement. Still further, the method comprises cutting a top surface of the pavement over the dowel.

In still another aspect of the invention, jointed concrete pavement comprises concrete cured around a dowel. The dowel comprises a welded seam carbon steel hollow tube and a pair of end caps. The end caps are attached to opposite axial ends of the hollow tube. The pavement comprises a fracture groove over the dowel.

Yet another aspect of the invention pertains to a method of forming jointed concrete pavement and comprises drilling a plurality of generally horizontal holes in a generally vertical face of cured concrete. Each hole has a generally cylindrical surface. The method further comprises inserting a dowel tube into each of the plurality of holes in a manner such that a portion of each of the dowel tubes extends outward from the vertical face of the cured concrete. Each dowel tube has an axial passageway extending therethrough, opposite axial ends, and a cylindrical outer surface. The method also comprises pumping grout through the axial passageway of each dowel tube in a manner causing the pumped grout to at least partially fill space between the generally cylindrical surface of the holes and the cylindrical outer surfaces of the dowel tubes. Still further, the method comprises pouring concrete over the portion of the dowel tubes that extend outward from the vertical face of the cured concrete after performing the above steps.

Further features and advantages of the present invention, as well as the operation of the invention, are described in detail below with reference to the accompanying drawings.

Figure 1:
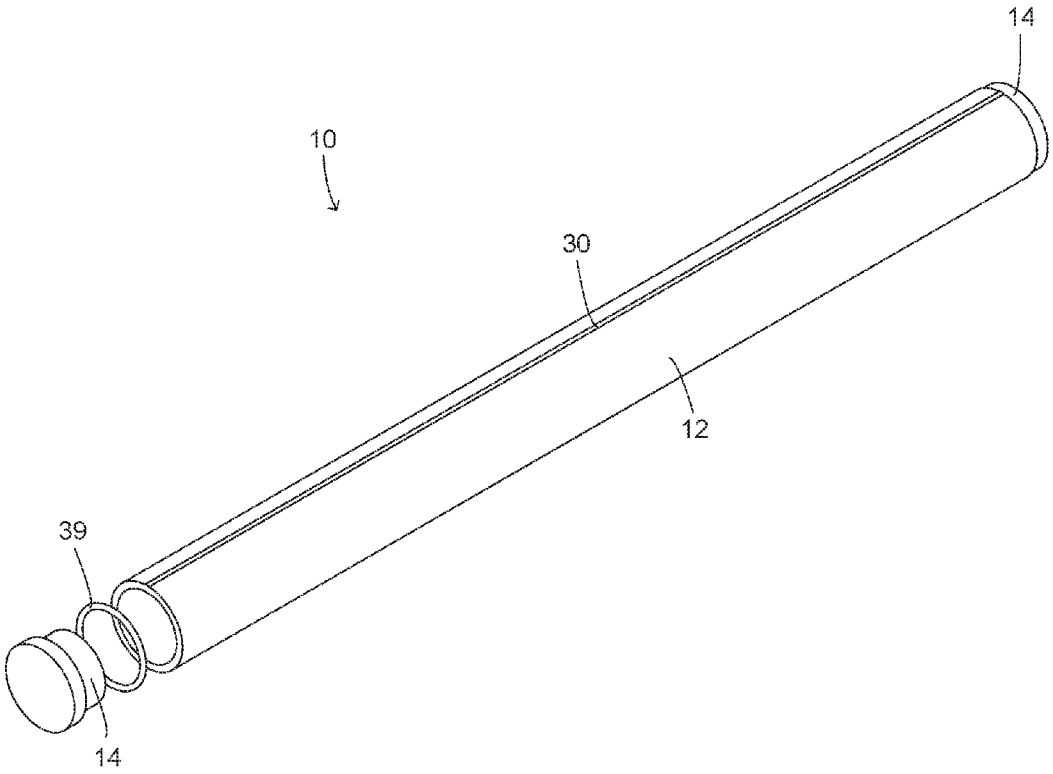
FIG. 1 depicts a perspective view of a carbon steel dowel tube in accordance with the invention.

Reference numerals in the written specification and in the drawing figures indicate corresponding items.

DETAILED DESCRIPTION

A carbon steel tube dowel assembly 10 in accordance with the invention is depicted in FIG. 1. The dowel assembly 10 comprises a seam welded carbon steel hollow tube 12 and a pair of end caps 14.

Figure 2:
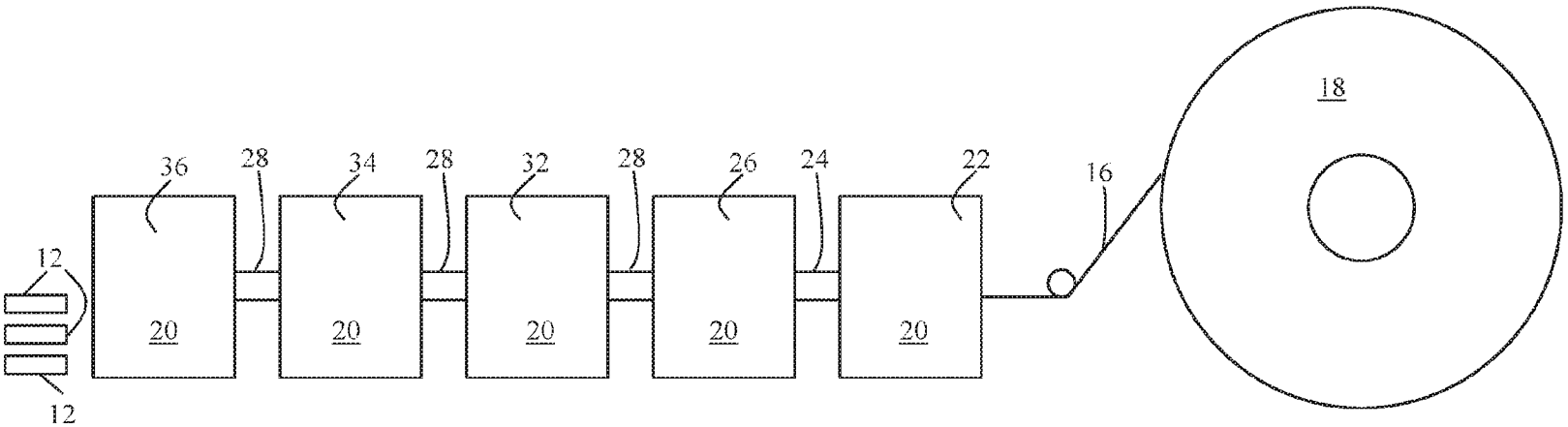
FIG. 2 depicts a schematic of the process for forming carbon steel tube dowels in accordance with the invention.

The tube 12 is preferably generally cylindrical and is formed from carbon steel strip stock (e.g., four inches (one hundred millimeters) by one-eighth inch (3.2 millimeters) grade 60 carbon steel strip). As shown schematically in FIG. 2, the strip stock 16 is provided on a spool 18 and is unwound and fed therefrom along a path that includes several processing stations 20. As the strip stock 16 is being processed, it continues to move along the path. The strip stock 16 travels along the path through a roll forming station 22 that bends the strip stock out of plane and into a tubular shape having an axis that is aligned with the direction of the path. Of course, immediately after roll forming the then tubular stock 24, the transverse cross-section of the tubular stock is an open ring (i.e. there is a discontinuity in the ring-shaped cross-section). Thus, the tubular stock 24, which continues to move along the path, is fed into a welding station 26. As the tubular stock 24 moves through the welding station 26, the discontinuity in the transverse cross-section of the tubular stock is welded closed, thereby forming a seam welded tube 28 having an axial seam weld 30 (see FIG. 1). Preferably the seam weld 30 is electric resistance welded.

Following the formation of the now seam welded tube 28, several optional processes may be performed on the tube prior to cutting the tube into lengths of individual dowel tubes 12. For example, the exterior of the welded tube 28 may be cleaned and dried at a cleaning station 32 in preparation for painting and thereafter spray painted or dipped at a coating station 34 while still continuously moving along the path. In addition or alternatively, the welded tube 28 may be epoxy coated at the coating station 34.

Following any optional in-line cleaning and/or coating processes, the welded tube 28 is transversely cut into length of individual dowel tubes 12 at a cutting station 36. This occurs as the welded tube 28 continuously moves along the path. Thus, the cutting station 36 comprises a cutting tool, such as a laser, water jet, or traditional toothed saw, that linearly reciprocates along the production path such that the cutting tool moves downstream at the same rate as the welded tube while it cuts the tube and thereafter quickly moves upstream to begin a new cut. In this manner, the cutting tool of the cutting station 36 can continuously transversely cut dowel tubes 12 from the recently formed welded tube 28 without pausing the unspooling of the strip stock 16 from the strip stock spool 18 or the forming and welding processes.

Following the cutting of the individual dowel tubes 12 from the welded tube 28, the dowel tubes can undergo several other optional processes via either automated or manual operations. For example, to the extent that the welded tube 28 was not earlier coated, the dowel tubes 12 may be cleaned and dried and thereafter coated as desired. If the strip stock 16 was originally galvanized, the dowel tubes 12 may be re-galvanized to galvanize the seam welds of the dowel tubes.

The actual dimensions of the dowel tubes 12 will likely be driven by various state requirements. For example, the diameter of the dowel tubes 12 may be required to be a particular nominal diameter that is anywhere from one-half of an inch (12.7 mm) to two inches (50.8 mm). Likewise, the wall thickness of the dowel tubes 12 may be required to be a particular nominal thickness that is anywhere from 0.065" to 0.1875" (1.7 to 4.8 mm). Still further, the length may be dictated by state regulations and may be anywhere from one to two feet (305 to 610 mm). Of course, if state regulations require dimensions outside of such ranges, the dowel tubes 12 can be manufactured to such dimensions as needed. Thus, these dimensions are merely suggestive of the dimensions of the actual dowel tubes 12.

Once the dowel tubes 12 are themselves complete, the end caps 14 can be inserted into or onto the axial ends of the dowel tubes 12. The end caps 14 are preferably made of relatively resilient polymeric material and are preferably simply press-fit into or onto the dowel tubes 12. If desired however, the end caps 14 may be epoxied or otherwise adhered to the dowel tubes 12. The completed dowel assemblies 10 are thereafter grouped and packaged for shipping.

As an additional option, a chemically active material may be used with the dowel tubes 12 to provide cathodic protection for the dowel. For instance, a washer 39 made from zinc may be inserted between the axial end of the dowel tubes 12 and the end caps 14 to act as a sacrificial anode. Other chemically active materials may also be used. The washer 39 may provide additional cathodic corrosion resistance to the ends of the dowel tubes 12. The washers 39 may be stamped from flat rolled material or formed from wire. The washers 39 may be the same diameter and thickness as the tubes 12. The washers 39 may encircle the end caps 14 or be inserted into the end caps (assuming the end caps are configured to encircle the ends of the dowel tubes rather than configured to be inserted into the ends of the dowel tubes). The use of the washers and the material of the washers may be dictated by state regulations. The washer may retard corrosion on the edge/end of the dowel tubes.

Figure 3:
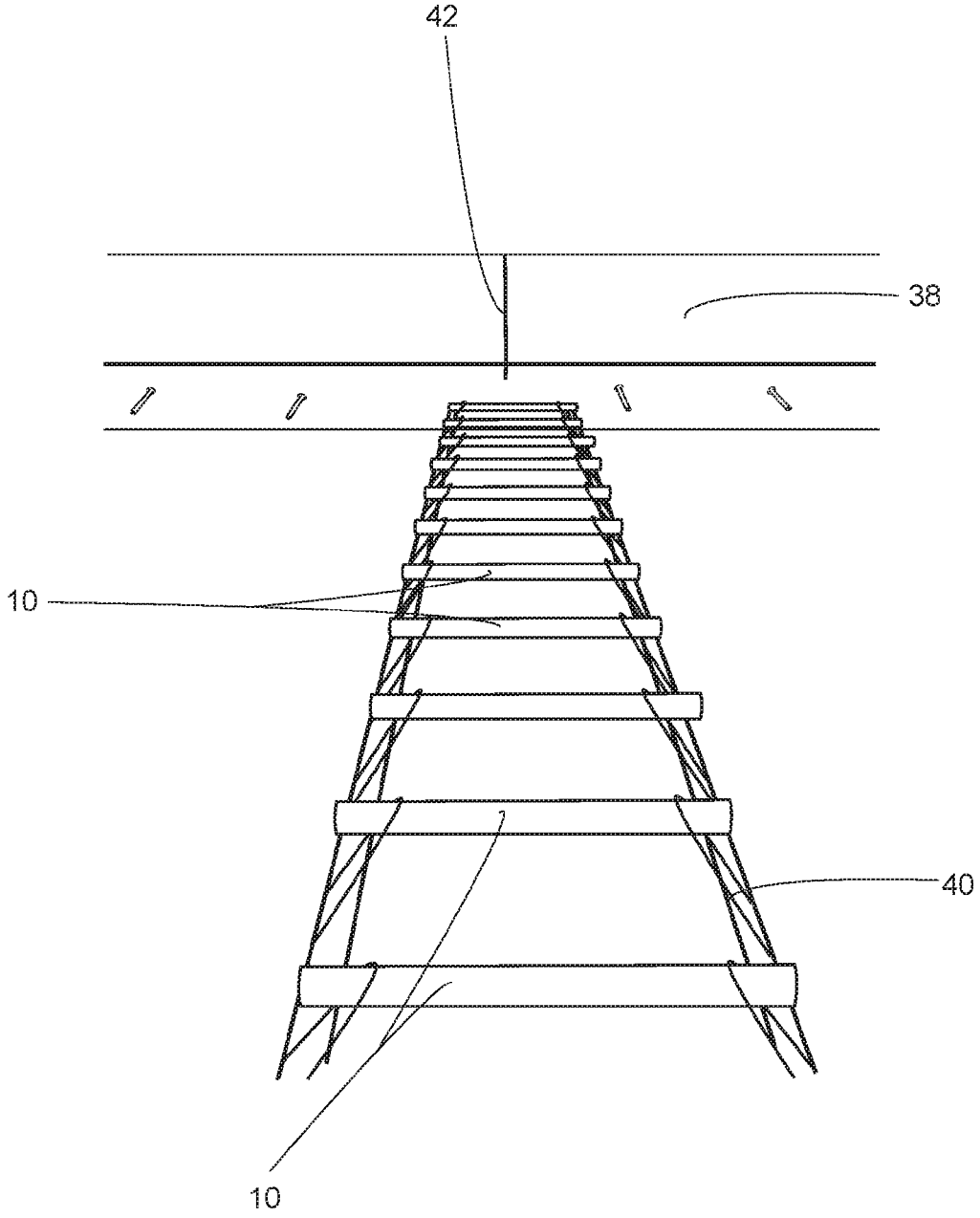
FIG. 3 depicts a perspective view of construction of concrete pavement using carbon steel tube dowels in accordance with the invention.

As shown in FIG. 3, the dowel assemblies 10 are used when forming concrete pavement 38 in a manner similar to conventional concrete pavement dowel rods. If desired or required by state regulations, the dowel assemblies 10 may be coated onsite with a release agent to prevent the dowel assemblies from adhering to the concrete. The dowel assemblies 10 can also be placed in baskets or cradles 40 prior to pouring the concrete pavement thereover. Alternatively, the tubular dowel assemblies 10 may also be inserted into poured, but uncured, concrete. For instance, the tubular dowel assemblies may be vibrated into the un-cured concrete as the concrete is being formed to a specific depth and specific spacing as required by state regulations. It should be appreciated that the end caps 14 of the dowel assemblies 10 prevent uncured concrete from filling the dowel tubes 12. While concrete in the dowel tubes 12 is not necessarily problematic, preventing concrete from slowly filling the dowel tubes after pouring and leveling the concrete eliminates air bubbles in the concrete above the dowel tubes and possible divots in the top surface of the concrete pavement 38. Additionally, the end caps 14 enclose the hollow interior cavities of dowel tubes 12. Optionally, a magnetic device (not shown) may be inserted in interior cavity of each dowel tube assembly 10 to allow for electro-magnetic alignment and positioning of the dowel as required by state regulations. Other measuring equipment configured to determine wheel transfer counters, weight per wheel, scales, clock timers, etc., may also be inserted in the interior cavities of the dowel tubes 12 prior to embedding the dowel assemblies in concrete. Data from such measuring equipment may assist state agencies in evaluating road usage patterns and future construction and design activities.

After the concrete pavement 38 has cured sufficiently over the dowel assemblies 10, the concrete pavement is transversely grooved by a saw to form a line of weakness 42 that ultimately results in a fracture through the depth of the concrete pavement. Alternatively, a groove may be pressed into the concrete when the concrete is only partially cured. Following the fracturing of the concrete (which occurs naturally and can take months or even years), transverse shear loads in the concrete pavement 38 will be carried across the fracture via the dowel assemblies 10.

For purposes of describing the invention the term "concrete" is used herein generically and should be construed as encompassing concrete, cement, grout, or any other form of cement.

In some situations it is desirable to join fresh concrete to cured concrete. For example, when concrete pavement becomes damaged, it is often repaired by cutting/jackhammering out the damaged portion and thereafter replacing the portion removed with new concrete. As another example, existing roadways may be expanded or connected to other portions of concrete pavement. When connecting fresh pavement to existing pavement, steel dowel bars/rods are often used to provide a shear connection between the new concrete and the old concrete. This is done by first drilling generally horizontal holes into the existing concrete on the vertical face of the concrete that will abut the newly poured concrete, and thereafter inserting dowel bars/rods into the holes. Typically the holes are oversized slightly to avoid fitting issues. The holes are drilled to a depth of approximately half the dowel length. Because of the oversizing of the drill holes, the holes are preferably grouted before inserting the dowel rods/bars therein in an effort to achieve a tight fit. The fresh concrete is then poured to the level of the cured concrete and eventually cures, trapping the opposite ends of the dowel rods/bars in the new concrete.

A problem with the above-mentioned method of joining fresh concrete to cured concrete is that often air gaps remain between the rods/bars and the drilled holes. This is problematic in that eventually such dowels can become loose in the holes. Once loose, the dowels tend to bang around inside the drilled holes of the older concrete. That can cause the older concrete to fail around the drilled holes and/or can cause failure of either older and/or newer concrete sections as a result of the loss of a strong direct shear connection between the two.

Figure 4:
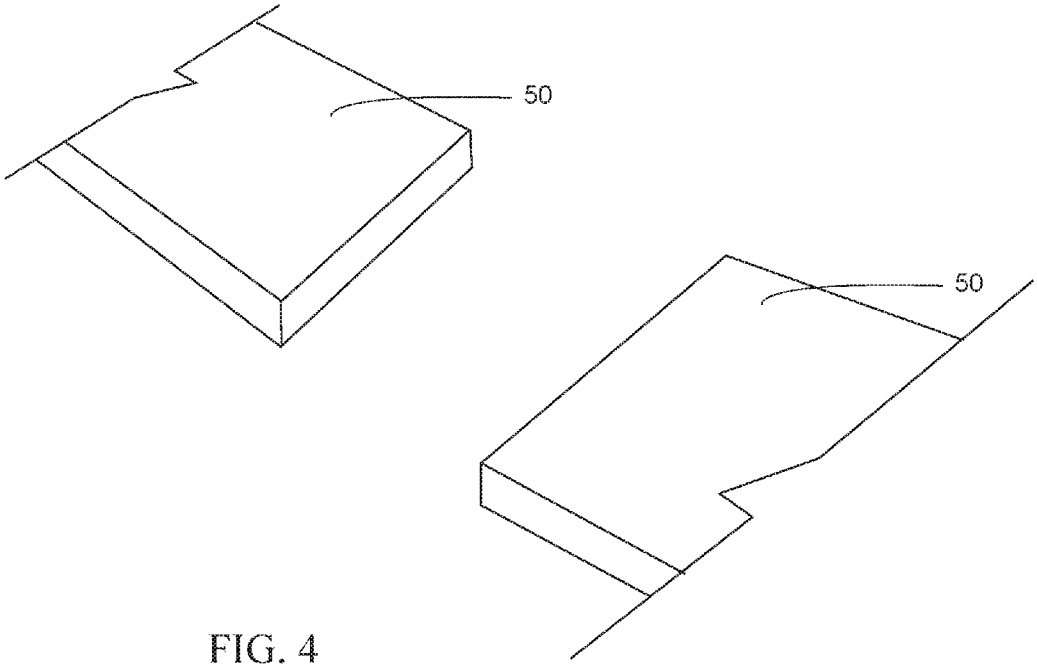
FIG. 4 depicts cured sections of concrete pavement with a gap therebetween that is to be filled with newly poured concrete.
Figure 5:
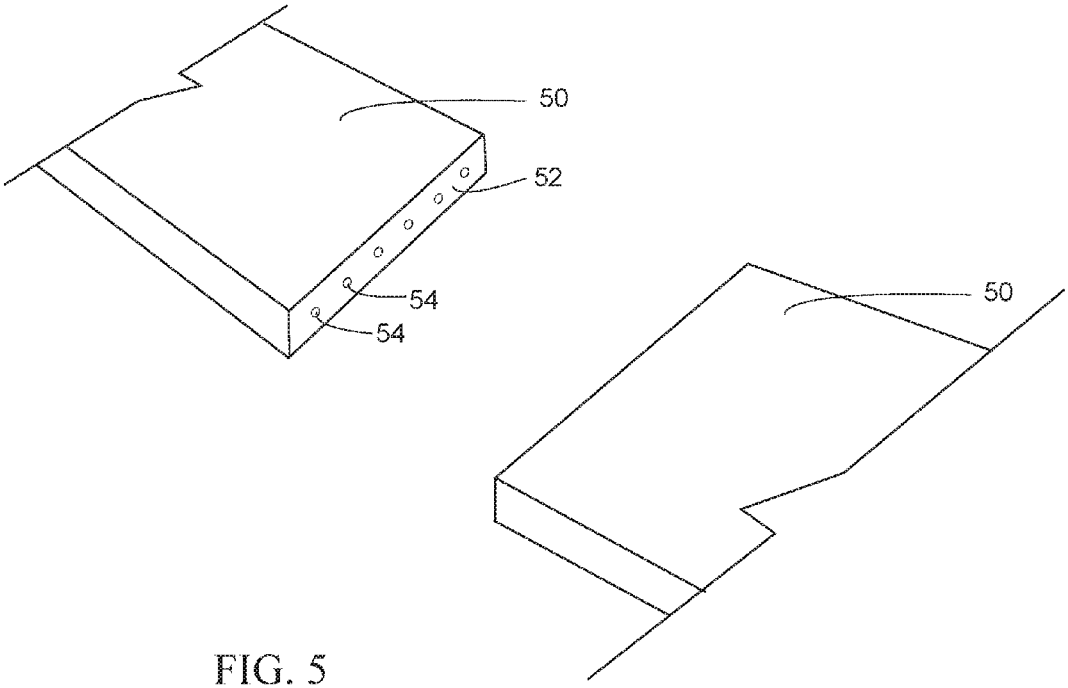
FIG. 5 depicts the same sections of concrete pavement after horizontal holes have been drilled into the vertical face of at least one of the cured sections of concrete.
Figure 6:
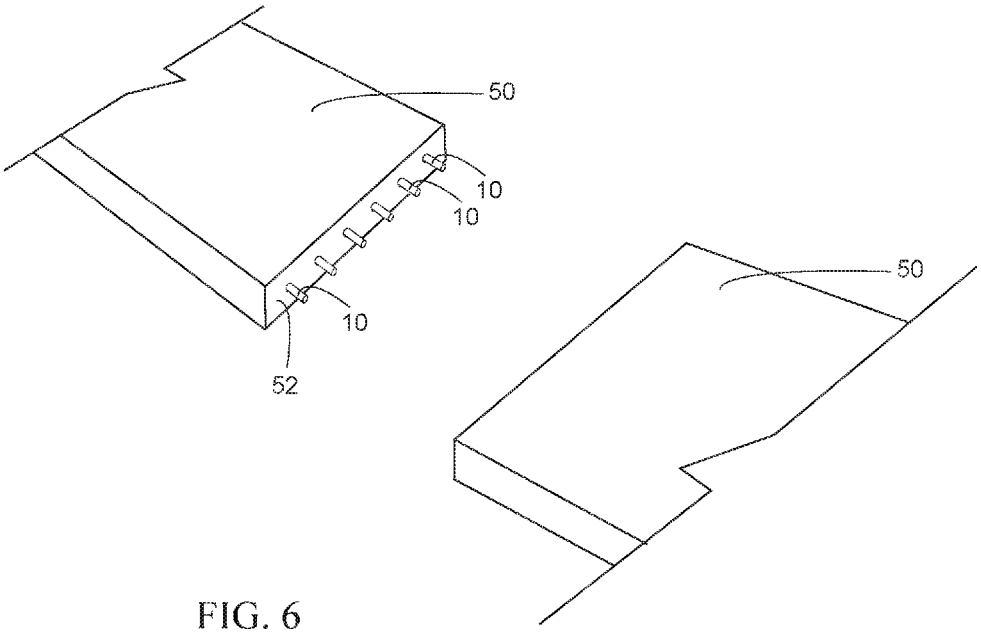
FIG. 6 depicts the same sections of concrete pavement after dowel tubes have been inserted into the holes drilled in the vertical face of the cured section of concrete.
Figure 7:
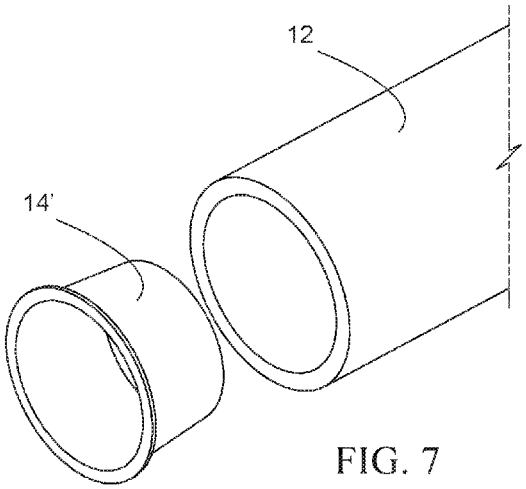
FIG. 7 depicts an exploded view of insert cap and an end of a dowel tube.
Figure 8:
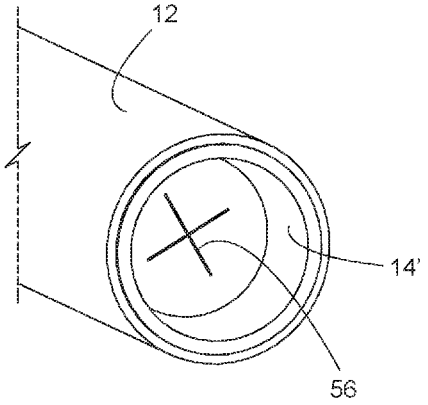
FIG. 8 depicts the insert cap attached to the end of the dowel tube.
Figure 9:
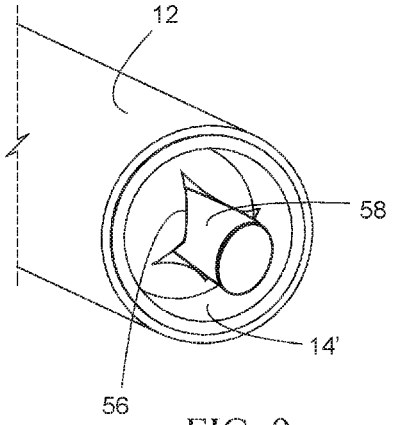
FIG. 9 depicts a tube extending through the dowel tube and the insert cap.

These problems can be eliminated by using tubular dowel assemblies 10 and performing the steps described below. Preferably, a method in accordance with the invention comprises initial steps similar to those described above. For example and as shown in FIG. 4, damaged/unwanted concrete may be removed (if necessary) leaving an existing cured section of concrete 50 with a vertical face 52 configured to abut new concrete pavement. Horizontal holes 54 can then be formed into the cured concrete section 50 through the vertical face 52. The holes 54 are preferably drilled to the depth of approximately half the length of the dowel assemblies 10. Preferably each dowel tube assembly 10 used for joining new concrete to cured concrete comprises an end cap 14' that comprises an axial opening 56 that extends through the end cap (as shown in FIGS. 7-9). That end cap 14' is attached to the end of the dowel assembly 10 that gets inserted into one of the horizontal drill holes 54 of the cured concrete 50.

After or before inserting a dowel tube assembly 10 into a drilled hole 54, a concrete pump hose or tube 58 is inserted through the dowel tube 12 of the dowel tube assembly and through the opening 56 of the end cap 14' from the end of the dowel tube assembly that protrudes or will protrude from the cured concrete 50 (see FIG. 9). The opening 56 of the end cap 14' preferably is just one or more slots that allow the end cap to resiliently deform around the pump hose/tube 58. With half of the dowel tube assembly 10 inserted into one of the holes 54 of the cured concrete 50, grout is then pumped through the dowel tube 12 and end cap 14' of the dowel tube assembly using a standard concrete pump (e.g., a pneumatically powered pump). During the grout pumping process, the end cap 14' limits the backflow of grout into the dowel tube 12 and helps direct the grout into the radial gap between the dowel tube assembly 10 and hole 54 of the cured concrete 50. By back-filling the grout in this manner all air between the dowel tube assembly 10 and the hole 54 of the cured concrete 50 is displaced from the hole, thereby ensuring an air pocket free interface between the dowel tube assembly and the hole. Following the grouting procedure, the pump tube/hose 58 is removed from the dowel assembly 10 and an end cap 14 or 14' is then attached to the exposed end of the dowel assembly. With this complete, the new section of concrete (not shown) can be poured adjacent to the cured concrete 50 and over the dowel tube assemblies 10. If desired, a release agent can be applied to the exposed surfaces of the dowel tube assemblies 10 before pouring the new concrete thereover.

It should be appreciated that, rather than inserting a pump hose/tube 58 through the dowel tube assembly 10, the pump hose may be attached to the exposed end of the dowel tube 12 using band-clamps or any other method. Thus, while not preferred, the hollow cavity of the dowel tube 12 may be pumped full of grout.

Figure 10:
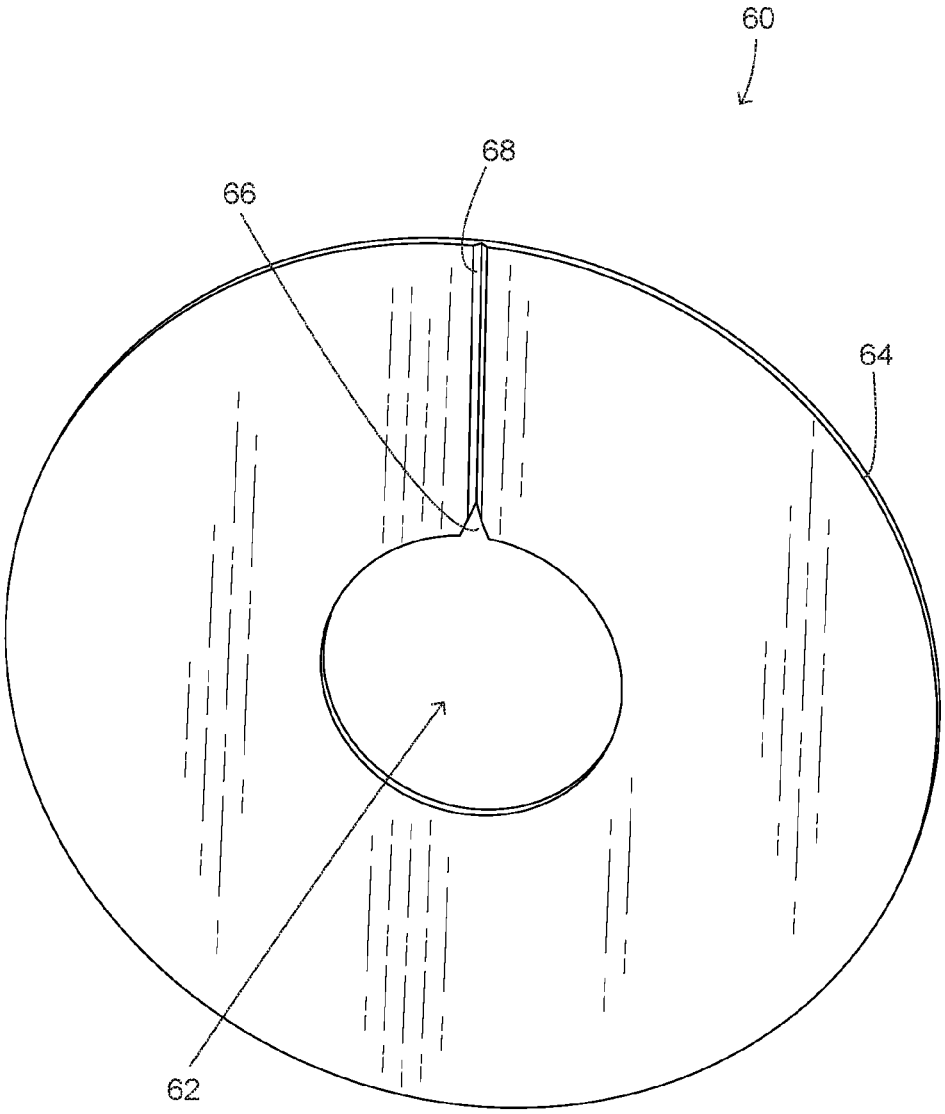
FIG. 10 depicts a grout ring configured to tightly encircle a dowel tube and be positioned between two adjacent sections of concrete pavement.

An optional grout ring 60 of the type shown in FIG. 10 can be utilized during the process of attaching new concrete to existing cured concrete. The grout ring 60 is preferably plastic and has a center hole 62 that is configured to tightly fit around a dowel tube 12. The outer perimeter 64 of the grout ring 60 is much larger such that the grout ring cannot pass into the holes drilled in the cured concrete 50. The center hole 62 of the grout ring 60 comprises a small notch 66 through which grout can pass. An indicator indentation or protrusion 66 is aligned with the notch 66 (the opposite side of the grout ring is flat and can be devoid of any indicator). The grout ring is slipped over a dowel tube 12 prior to grouting the dowel tube in the hole 54 of the cured concrete 50. The grout ring 62 is oriented with its indicator 68 in the uppermost position. As such, the notch 66 of the grout ring 62 is positioned above the dowel tube 12. With the grout ring flat against the vertical face 52 of the cured concrete, grout can be pumped through the dowel tube 12 using any of the techniques described above. When the grout around the dowel tube assembly 10 reaches the vertical face 52 of the cured concrete 50, the grout ring 60 will prevent grout from spilling out of the hole 54 of the cured concrete before the grout completely displaces all of the air between the dowel tube assembly and the hole. Thus, when grout begins to extrude through the notch 66 of the grout ring 60, the air between the dowel tube assembly 10 and the hole 54 has been completely displaced. The grout ring 60 can be removed from the dowel tube assembly 10 after the grouting procedure or it can be left on the dowel tube assembly to be embedded in new concrete.

It should be appreciated that the grouting step(s) of the present invention does not add appreciable time to preparing dowels for pouring since the prior art method of filling drilled holes with concrete is also time consuming.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the method of connecting new concrete to existing cured concrete can be perform using welded seam dowel tubes or seamless extruded dowel tubes. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A dowel for forming jointed concrete pavement, the dowel comprising a welded seam carbon steel hollow tube and a pair of end caps, the end caps being attached to opposite axial ends of the hollow tube, the endcaps extending into the hollow tube and extending diametrically not beyond the hollow tube, the hollow tube having an internal axial passageway and an outer cylindrical surface, the end caps partially extending into the axial passageway of the hollow tube and having an outer most diameter that is less than or equal to the diameter of the cylindrical outer surface of the hollow tube and that is greater than the diameter of the axial passageway of the hollow tube.

2. The dowel of claim 1 wherein the end caps are formed of a polymeric material.

* * * * *